United States Patent [19]

Ver Loren van Themaat et al.

[11] Patent Number: 4,920,331

[45] Date of Patent: Apr. 24, 1990

[54] SECURITY BARRIER WITH INTRUSION SESNING AND DELAYING MEANS

[75] Inventors: Hendrik M. Ver Loren van Themaat; Pieter L. Raath, both of Pretoria, South Africa

[73] Assignee: Sekerheid En Elektronika Laboratoria, Pretoria, South Africa

[21] Appl. No.: 259,282

[22] Filed: Oct. 18, 1988

[30] Foreign Application Priority Data

Oct. 19, 1987 [ZA] South Africa ..... 87/7852

[51] Int. Cl.[5] ..... G08B 13/12; G08B 15/00

[52] U.S. Cl. ..... 340/541; 256/12; 340/550

[58] Field of Search ..... 340/550, 541; 256/11, 256/10, 12, 19, 31, 24, 73, 23; 405/6

[56] References Cited

U.S. PATENT DOCUMENTS

| | | | |
|---|---|---|---|
| 4,081,177 | 3/1978 | Graff | 256/12 |
| 4,155,083 | 5/1979 | Slaats et al. | 340/541 |
| 4,525,701 | 6/1985 | Leih | 340/541 |
| 4,533,906 | 8/1985 | Amir | 340/541 |

FOREIGN PATENT DOCUMENTS

| | | |
|---|---|---|
| 85/2461 | 4/1985 | South Africa . |
| 85/6293 | 8/1985 | South Africa . |
| 86/0452 | 1/1986 | South Africa . |
| 86/3018 | 4/1986 | South Africa . |

*Primary Examiner*—Glen R. Swann, III
*Attorney, Agent, or Firm*—Kenyon & Kenyon

[57] ABSTRACT

A security installation for a property includes an imperforate protective barrier, a plurality of spaced posts extending upwardly from the top of the barrier and a plurality of spaced trip wires extending between the posts for detecting the presence of an intruder breaching, or attempting to breach, the barrier. The installation further includes a plurality of spaced posts protruding transversely from the inner side of the barrier, and a plurality of electrical wires extending between the posts. The electrical wires are adapted to impart at least a temporarily incapacitating shock to an intruder.

17 Claims, 1 Drawing Sheet

SECURITY BARRIER WITH INTRUSION SESNING AND DELAYING MEANS

BACKGROUND OF THE INVENTION

This invention relates to a security installation for a property.

Heretofore, various types of security installations have been known for securing a property. For example, it has been known to provide a security system for a property, which includes a fence around the periphery of the property, and warning means, associated with the fence, for warning the occupants of the property that the fence is breached, or an attempt is being made to breach the fence. However, this system has the drawback that it usually does not reduce the rate of progress or penetration of the intruder over or through the fence sufficiently to allow a reaction force to reach the place of breaching before the breaching has been completed, i.e. before the intruder gains access to the property.

It is an object of this invention to provide a security installation for a property whereby these drawbacks are at least reduced.

According to the invention, there is provided a security installation for a property, which includes an imperforate protective barrier extending upwardly from the ground and having a first side facing away from a property protected by the barrier, as well as a second side facing towards the property with at least the second side extending vertically upwardly;

detection means in or on the barrier for detecting the presence of an intruder breaching, or attempting to breach, the barrier; and delaying means protruding from the second side of the barrier at a lower level than the detection means, and adapted to delay the intruder on the intruder's breaching the barrier.

The barrier may be in the form of a wall with the first side of the wall also extending substantially vertically. The wall may comprise a plurality of spaced posts extending upwardly from the ground and barrier sections spanning the gaps between adjacent posts. The barrier sections may be adapted to yield on a person's scaling or attempting to scale the barrier sections.

The barrier may surround the property, and the barrier sections or portions may each comprise a core or membrane of apertured material attached to adjacent pairs of posts, and settable material covering the core so that it is embedded in the settable material. The apertured material may comprise metal strands arranged to define apertures between them, and the settable material may be cementitious material. Hence, since the barrier is imperforate a potential intruder will not readily be able to survey the property. Furthermore, the barrier portions or sections give or yield, i.e. they absorb energy, hence making scaling of the barrier difficult.

The security installation may include stays for supporting the wall in an upright position. The wall may extend at least half a meter, e.g. about one meter, into the ground and at least two meters above the ground.

The detection means may comprise primary and/or secondary detection means, which may be located in proximity to the top of the wall. The primary detection means, when present, may be located on top of the wall, and the secondary detection means, when present, may be located within the wall and/or along a side of the wall. The primary detection means may include a plurality of spaced posts extending upwardly from the top of the wall, a plurality of trip or sensor wires, spaced apart from one another vertically, extending between the posts, and warning means operatively connected to the trip or sensor wires. For example, the warning means may be adjusted so that, on the trip wires being displaced, the warning means is actuated. Hence, the trip wires will be displaced on the intruder's attempting to breach the barrier by climbing over it.

The secondary detection means may comprise at least one elongate detection or warning means extending along the wall above ground level and located within the wall, the elongate detection or warning means adapted to be actuated on attempted penetration of the wall. The elongate detection or warning means may comprise a wire or cable and a warning device operatively connected to the wire. The wire may be embedded in the wall and adapted to sense breaching, e.g. by means of vibrations. Hence, the elongate detection or warning means will be actuated on the intruder's attempting to breach the barrier by climbing over it.

The delaying means may be electrically operable, e.g. be in the form of at least one high voltage cable or wire, and/or be of mechanical nature, e.g. in the form of a roll of razor or dannert wire.

The delaying means may, in one embodiment, comprise a plurality of spaced posts protruding transversely from the wall and extending around the inner periphery of the wall, and a plurality of electrical wires, spaced apart from one another along the posts, extending between the posts. The wires may be adapted to impart at least a temporarily incapacitating shock to an intruder, i.e. the current and voltage in the wires may be such that an intruder will only be temporarily incapacitated on touching the wires. Instead, the current and voltage may be such that an intruder will be maimed or killed. In another embodiment, the delaying means may comprise posts or supports, and a roll or coil of razor or barbed wire extending between the posts.

The posts of the primary detection means and/or those of the delaying means may generally be of a non-supportive nature so that, while they can support their associated wires, they can not support an intruder, a ladder, etc.

The distance between the top of the wall and/or the primary detection means, and the wire of the delaying means which is furthest from the wall may be sufficiently great, e.g. for example at least 1.5 meters, so that an intruder, when positioned on top of the wall, cannot readily jump over the delaying means or obtain access to the delaying means, e.g. to cut the wires.

The security installation may include a further or secondary delay or delaying means extending along the inner periphery of the wall and protruding transversely therefrom, and spaced vertically from the other or primary delaying means.

The secondary delaying means may also comprise a plurality of spaced posts protruding transversely from the wall, and a plurality of electric wires, spaced apart from one another along the posts, extending between the posts, the wires being adapted to impart at least a temporarily incapacitating shock to an intruder.

BRIEF DESCRIPTION OF THE DRAWINGS

The invention will now be described by way of example with reference to the accompanying diagrammatic drawings wherein.

DESCRIPTION OF THE PREFERRED EMBODIMENTS

Figure 1:
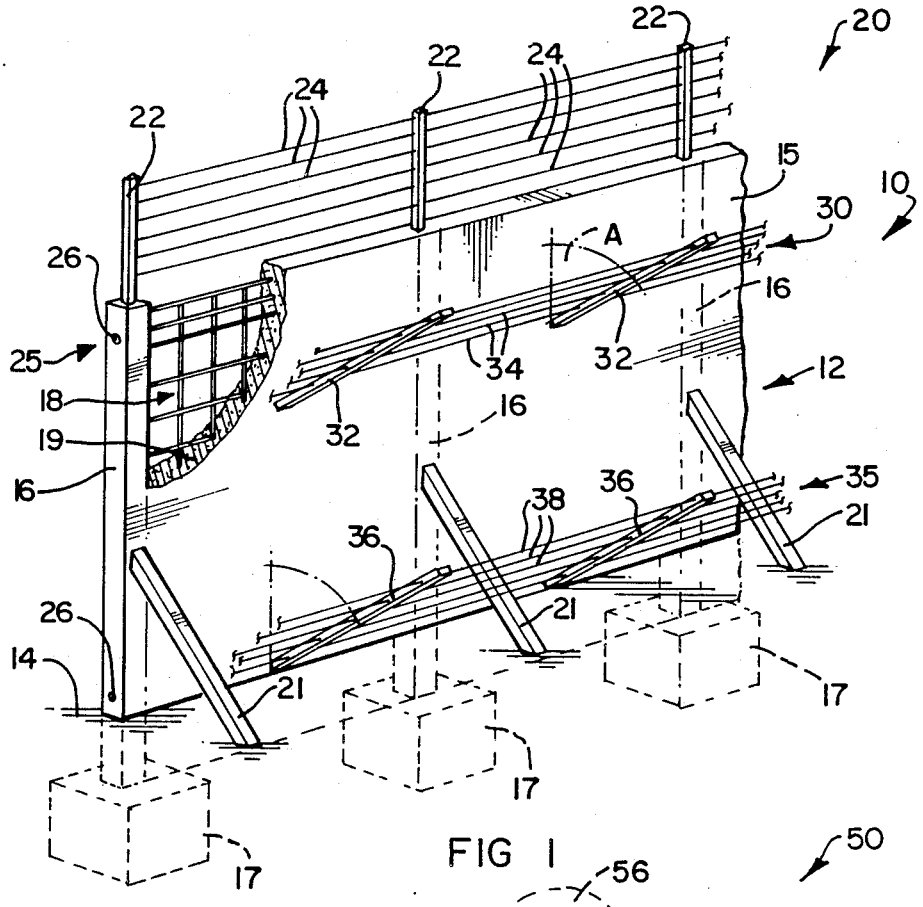
FIG. 1 shows a three-dimensional view of part of a security installation according to one embodiment of the invention, with parts shown in section, for clarity.

Referring to FIG. 1, reference numeral 10 generally indicates a security installation in accordance with one embodiment of the invention, wholly surrounding a property (not shown).

The security installation 10 includes a wall 12 extending upwardly from the ground 14. The wall 12 comprises a plurality of posts 16, spaced apart from one another. Each post 16 is embedded in the ground 14 by means of a foundation 17. An apertured membrane or mesh 18, having metal strands, spans the opening between adjacent pairs of posts. Cementitious material 19, e.g. concrete, covers the mesh 18 so that the mesh 18 is embedded in the cementitious material. The wall 12 has a first vertical side 13 see (FIG. 2) facing away from a property to be protected, as well as a second vertical side 15 facing the property.

In use, the posts 16 are embedded in the concrete foundations 17 in the ground 14, and the mesh 18 is spanned between adjacent pairs of posts. Each of the posts 16 is provided with a stay 21 for supporting it in an upright position. Thereafter, shuttering or the like (not shown) is provided on one side of the posts 16, i.e. either on the inside or on the outside thereof, and settable cementitious material 19 is applied to the space defined between the posts and the shuttering so that the mesh 18 is embedded in the cementitious material. The cementitious material may be applied by a process such as that known under the trade name 'guniting'.

The sections between the posts 16 are hence relatively unstable and yield on a person's attempting to scale the wall, making such an operation very difficult.

The wall 12 may extend about half a meter into the ground 14, and about three meters above the ground, and it may be about 5–7 cm thick.

The security installation 10 also includes primary detection means, generally indicated by reference numeral 20, located on top of the wall 12. The detection means 20 includes a plurality of upright posts 22, spaced apart from one another along the top of the wall. The detection means 20 also includes a plurality of warning wires 24, spaced apart from one another vertically and extending between the posts 22. The spacing between the warning wires 24 is such that an intruder cannot pass between adjacent pairs of wires without touching or displacing the wires.

The installation 10 also includes secondary detection means, generally indicated by reference numeral 25. The detection means 25 comprises a wire 26 embedded in the cementitious material 10 (and passing though the posts 16) so that it extends along the wall 12. Two of the wires 26, spaced apart from each other vertically, are provided.

The installation 10 also includes primary delay or delaying means, generally indicated by reference numeral 30. The delaying means 30 includes a plurality of posts 32 protruding outwardly from the wall 12 along the inner periphery thereof, at an oblique angle. The included angle 'A' which the posts 32 form with the wall 12 may be about 45°. The delaying means 30 also includes a plurality of electrical wires 34 spaced apart from one another along the posts 32 and extending between adjacent pairs of posts. In use, the voltage passing through the wires 34 can be selected so that they will either delay, maim or kill an intruder (not shown), who contacts the wires.

The detection means 20 may extend about 1 meter above the top of the wall 12, and the lower ends of the posts 32 may be attached to the wall about 1–1½ meters below the top of the wall. Hence, the wires 34 will be spaced a sufficient distance from the top of the wall 12 so that an intruder located on top of the wall, cannot readily access the wires 34 to cut them, or the like.

The posts 22 and 32 are generally of a non-supportive nature, or are non-supportively attached to the wall 12, so that, while they will support the wires 24, 34 respectively, they will not support the weight of an intruder, a ladder, or the like (not shown).

The installation 10 also includes delaying means, generally indicated by reference numeral 35, spaced apart vertically from the delaying means 30. The delaying means 35 comprises posts 36 or supports extending obliquely outwardly from the wall 12 and electric wires 38 extending between the posts. In use, the wires 38 will serve to delay, maim or kill an intruder penetrating the wall 12 or digging underneath the wall 12.

It is to be noted that the spacing between the wires 34, 38 is such that an intruder cannot pass between adjacent pairs of wires, without touching or displacing the wires.

Finally, the installation 10 may include a safety fence (not shown) on the inside of the wall 12, and spaced several meters therefrom, e.g. about 4 meters. This will prevent accidental contacting of the delaying means 30, 35 by persons occupying the property.

The wires 24, 26, 34 and 38 are connected to control means (not shown) in an appropriate location (e.g. in a guard house—not shown). The control means is adapted so that, on an intruder's touching any of the wires or, where applicable, the wires sensing the presence of the intruder, a signal is transmitted to the control means which emits a warning signal. The control means is further adapted to indicate the place of breach or attempted breach of the wall by the intruder.

The successful protection of a property depends on various factors, such as detection of the presence of an intruder penetrating, crossing or attempting to penetrate/cross a barrier around a property and the generation of information to this effect, analysis of this information, communication of the analysed information to a reaction force, and reaction by the reaction force against the intruder. Hence, the time delay which the barrier provides, i.e. the delay which the intruder penetrating the barrier is subjected to, must be equal to or greater than the time required for these steps.

As regards the wall 12, an intruder can, apart from attempting to cross over the top of the wall, also attempt to penetrate the wall by removing the cementitious material 12, and cutting the mesh 18. However, adequate protection against penetration in this manner will be achieved with the wall 12, e.g. until a reaction force can arrive on the scene. It is to be understood that the wall 12 need not necessarily include the mesh and/or the cementitious material, but can be of any other suitable opaque material which can resist attempts to penetrate it, e.g. which can resist impact blows imparted to it by means of a hammer, crow-bar, or the like (not shown), by absorbing or deflecting the energy transmitted by such means, etc. If desired, the wall 12 can also have a degree of resiliency for this purpose.

A further advantage of the wall 12, which is opaque, is that an intruder cannot readily observe or study the property inside the wall 12, i.e. visual inspection of activities within the wall 12, such as the position of reaction forces, etc, is difficult.

The wires 26, for detecting penetration or attempted penetration of the wall 12, may be those operable on an electret basis. In other embodiments, microphones and/or break-wire means (not shown) may be used instead of, or in addition to, the 'electret' wires.

The wires 34, 38 may either be activated full-time, or can be such that they are activated only when penetration (breach) or attempted penetration, or crossing over of the wall 12, is detected. When the voltage in the wires 34, 38 is such that an intruder can only be delayed or maimed, the effect is that they then serve as a delay means to allow the reaction force sufficient time to reach the point or area of penetration.

The wires 24 of the detection means 20 may be short-circuit wires, capacitance wires, pull-wires, leaking cables, wave-guide property change wires, or the like. The purpose of the detection means 10 is to detect attempted crossing over or scaling of the wall 12. The means 20 also serve as an interference means for interfering with the progress of the intruder.

Figure 2:
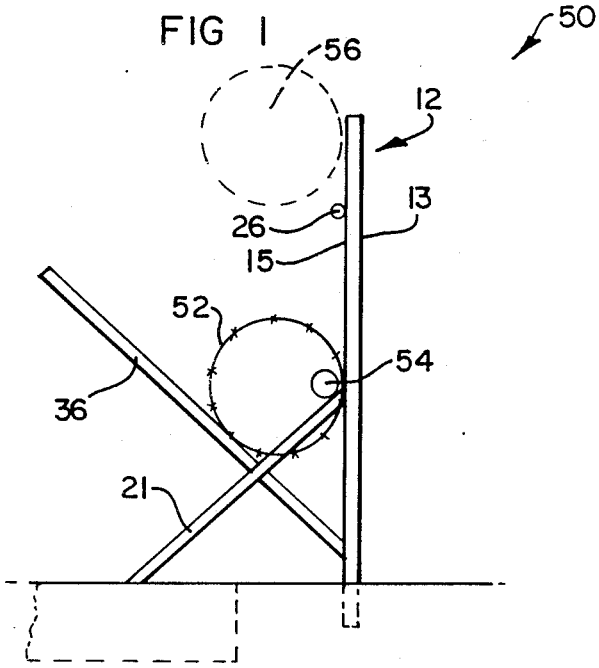
FIG. 2 shows a side view of a security installation according to another embodiment of the invention.

Referring to FIG. 2, reference numeral 50 generally indicates a security installation for a property, according to another embodiment.

Parts of the security installation 50 which are the same or similar to those of FIG. 1, are indicated with the same reference numerals.

A plurality of posts 36 protrude obliquely upwardly from the side 15 of the wall 12. Typically, the lower ends of the posts 36 are located about 0.5 m above the ground 14, with their upper ends located about 0.5 m lower than the top of the wall 12. The upper ends of the posts 36 are typically spaced about 1.5 m from the top of the wall 12.

Delaying means in the form of a roll of razor or dannert wire 52 is mounted on the stays 21, while a high voltage cable 54 is also mounted on the stays 21 so that it is located within the roll of dannert wire 52.

A roll or coil of dannert wire 56 may also be mounted to the top of the wall. More than one such roll or coil located adjacent each other, can be provided.

Apart from the detection wire or cable 26, the installation 50 may also include detection means (not shown), similar to the detection means 20 of FIG. 1.

The detection means is thus located or deployed more-or-less vertically above the delaying means, with the width of the delaying means being greater than the width of the wall. Hence, controlled breaching of the detection means is hindered by its vertical deployment above the delaying means, since gravity dictates that a person breaching it moves generally vertically downwardly, with the delaying means then acting as a hindrance below such person.

The installations 10, 50 are believed to be safe for use against inadvertent attempted penetration by innocent intruders since the wall 12 must be scaled or penetrated before such an intruder will contact the wires 34, 38. Furthermore, the safety fence along the inside of the wall 12 prevents an innocent person occupying the property from coming into contact with the wires 34, 38. The installations 10, 50 are also compact, i.e. they do not occupy large areas, relatively inexpensive, effective and require little or no maintenance.

We claim:

1. A security installation for a property, which includes an imperforate protective barrier extending upwardly from the ground and having a first side facing away from a property protected by the barrier, as well as a second side facing towards the property, with at least the second side extending vertically upwardly;

detection means in or on the barrier for detecting the presence of an intruder breaching, or attempting to breach, the barrier; and delaying means protruding from the second side of the barrier at the lower lever than the detection means, and adapted to delay the intruder on the intruder's breaching the barrier.

2. A security installation according to claim 1, wherein the barrier is in the form of a wall comprising a plurality of spaced posts extending upwardly from the ground and barrier sections spanning the gaps between adjacent posts, with the barrier sections adapted to yield on a person's scaling or attempting to scale the barrier sections.

3. A security installation as claimed in claim 2, wherein the barrier surrounds the property, and wherein each barrier section comprises a core or membrane of apertured material extending between adjacent posts, and cementitious material covering the core so that the core is embedded in the cementitious material.

4. A security installation as claimed in claim 3, wherein the detection means comprises a plurality of spaced posts extending upwardly from the top of the wall, a plurality of trip or sensor wires, spaced apart from one another vertically, extending between the posts, and warning means operatively connected to the trip or sensor wires.

5. A security installation as claimed in claim 4, wherein the delaying means comprises a plurality of spaced posts protruding transversely from the wall and extending around the inner periphery of the wall, and a plurality of electrical wires, spaced apart from one another along the posts, extending between the posts, the wires being adapted to impart at least a temporarily incapacitating shock to an intruder.

6. A security installation as claimed in claim 5, wherein the posts of the detection means and/or those of the delaying means are of a generally non-supportive nature so that, while they can support their associated wires, they can not support an intruder.

7. A security installation as claimed in claim 5, wherein the distance between the top of the wall and/or the detection means and the wire of said delaying means which is furthest from the wall is at least 1.5 meters so that an intruder, when positioned on top of the wall, cannot readily jump over the delaying means or obtain access to the delaying means.

8. A security installation as claimed in claim 3, wherein the detection means comprises at least one elongate detection means extending along the wall above ground level and located within the wall, the elongate detection means adapted to be actuated on attempted penetration of the wall.

9. A security installation as claimed in claim 2, which includes a further or secondary delaying means extending along the inner periphery of the wall and protruding transversely therefrom, and spaced vertically from the other or primary delaying means.

10. A security installation as claimed in claim 9, wherein the secondary delaying means also comprises a plurality of spaced posts protruding transversely from the wall, and a plurality of electric wires, spaced apart from one another along the posts, extending between the posts, the wires being adapted to impart at least a temporarily incapacitating shock to an intruder.

11. A securing installation for a property comprising an imperforate vertically disposed barrier for encompassing the property with one side facing towards the property;

detection means on said barrier for detecting the presence of an intruder on said barrier; and delaying means protruding from said one side of said barrier at a lower level than said detection means for delaying an intruder breaching said barrier.

12. A security installation as set forth in claim 11 wherein said barrier comprises a plurality of vertically spaced posts and barrier sections between adjacent posts, each said barrier section adapted to yield on a person's attempting to scale a respective barrier section.

13. A security installation as set forth in claim 11 wherein said detection means comprises a plurality of spaced posts extending upwardly from said barrier, a plurality of sensor wires spaced apart from one another vertically and extending between said posts, and warning means operatively connected to said sensor wires.

14. A security installation as set forth in claim 13 wherein said detection means comprises secondary detection means located within said barrier including at least one elongate warning means extending above ground level to be actuated on attempted penetration of said barrier.

15. A security installation as set forth in claim 11 wherein said delaying means comprises a plurality of spaced posts protruding transversely from said barrier and extending around an inner periphery of said barrier, and a plurality of electrical wires spaced apart from one another along said posts and extending between said posts, said wires being adapted to impart at least a temporarily incapacitating shock to an intruder.

16. A security installation as set forth in claim 11 which further includes a secondary delaying means extending along said one side and protruding transversely therefrom and spaced vertically from said delaying means.

17. A security installation as set forth in claim 16 wherein said secondary delaying means comprises a plurality of spaced posts protruding transversely from said side and a plurality of electric wires spaced apart from one another along said posts and extending between said posts, said wires being adapted to impart at least a temporarily incapacitating shock to an intruder.

* * * * *

UNITED STATES PATENT AND TRADEMARK OFFICE

CERTIFICATE OF CORRECTION

PATENT NO. : 4,920,331

DATED : April 24, 1990

INVENTOR(S) : HENDRIK M. VER LOREN VAN THEMAAT, et al

It is certified that error appears in the above-identified patent and that said Letters Patent is hereby corrected as shown below:

Front page [54] "SESNING" should be -SENSING-
(Column 1, line 2)
Column 3, line 23 "see (FIG. 2)" should be -(see FIG. 2)
Column 6, line 16 "the" (last occurrence) should be -a-
Column 6, line 16 "lever" should be -level-
Column 7, line 11 "securing" should be -security-

Signed and Sealed this

First Day of October, 1991

*Attest:*

*Attesting Officer*

HARRY F. MANBECK, JR.

*Commissioner of Patents and Trademarks*